US006523504B2

(12) United States Patent
Miura

(10) Patent No.: US 6,523,504 B2
(45) Date of Patent: Feb. 25, 2003

(54) CONTROL SYSTEM FOR CONTROLLING VARIABLE VALVE TYPE INTERNAL COMBUSTION ENGINE

(75) Inventor: Hajime Miura, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/810,532

(22) Filed: Mar. 19, 2001

(65) Prior Publication Data

US 2001/0023667 A1 Sep. 27, 2001

(30) Foreign Application Priority Data

Mar. 23, 2000 (JP) ..... 2000-081891

(51) Int. Cl.[7] ..... F02B 69/06
(52) U.S. Cl. ..... 123/21; 123/90.11
(58) Field of Search ..... 123/21, 90.11, 123/347, 90.15

(56) References Cited

U.S. PATENT DOCUMENTS

| | | | | | |
|---|---|---|---|---|---|
| 4,237,832 | A | * | 12/1980 | Hartig et al. | 123/198 F |
| 4,945,870 | A | * | 8/1990 | Richeson | 123/179.21 |
| 5,022,353 | A | * | 6/1991 | Kamamura | 123/21 |
| 5,036,801 | A | * | 8/1991 | Imajou | 123/21 |
| 5,117,790 | A | * | 6/1992 | Clarke et al. | 123/198 F |
| 5,154,141 | A | * | 10/1992 | McWhorter | 123/21 |
| 5,193,492 | A | * | 3/1993 | Kawamura | 123/21 |
| 5,517,951 | A | * | 5/1996 | Paul et al. | 123/21 |
| 5,592,905 | A | * | 1/1997 | Born | 123/90.11 |
| 5,699,758 | A | * | 12/1997 | Clarke | 123/21 |
| 6,286,466 | B1 | * | 9/2001 | Braun et al. | 123/21 |

FOREIGN PATENT DOCUMENTS

| | | |
|---|---|---|
| DE | 27 03 067 A1 | 7/1978 |
| EP | 0 352 861 A2 | 1/1990 |
| EP | 0 387 372 A1 | 9/1990 |
| JP | 8-200025 | 8/1996 |
| JP | 2000-45804 | 2/2000 |
| WO | 01 00974 A1 | 1/2001 |

* cited by examiner

*Primary Examiner*—Henry C. Yuen
*Assistant Examiner*—Hai H. Huynh
(74) *Attorney, Agent, or Firm*—Foley & Lardner

(57) ABSTRACT

A control system for an engine comprises an operation range judging section that judges an operation range assumed by the engine, a variable cycle operating section that switches the operation of the engine between 4-cycle operation and a different cycle operation in accordance with a judgment made by the operation range judging section, the different cycle operation being of an operation whose cycle is different from 4-cycle, and an intermediate variable cycle operating section that allows part of the cylinders to carry out 4-cycle operation and remaining part of the cylinders to carry out the different cycle operation when the operation range judging section judges that the engine is under an intermediate operation range assumed between an operation range provided by 4-cycle operation and an operation range provided by the different cycle operation.

31 Claims, 7 Drawing Sheets

CONTROL SYSTEM FOR CONTROLLING VARIABLE VALVE TYPE INTERNAL COMBUSTION ENGINE

BACKGROUND OF THE INVENTION

1. Field of the Invention

The present invention relates in general to control systems for controlling internal combustion engines of a variable valve type wherein open/close movements of the intake and exhaust valves are controlled in accordance with an operation condition of the engine, and more particularly to the control systems of a type that controls the intake air amount by controlling the close timing (viz., open period) of each intake valve to carry out a so-called non-throttle operation of the engine. More specifically, the present invention is concerned with the control systems of a type that allows the engine to work under various operation cycles.

2. Description of the Prior Art

Nowadays, variable valve type internal combustion engines are widely employed in motor vehicles for the superiority of the engine. In fact, fuel consumption and driveability under lower speed and low load engine operation are improved and at the same time due to increased mixture charging effect, sufficient output under high speed and high load engine operation is obtained.

For controlling such engines, Laid-open Japanese Patent Application (viz., Tokkaihei) 8-200025 shows a control system. The variable valves of this publication are actuated by electromagnetic actuators, and the open/close movements of them are controlled by the control system through the actuators. Each cylinder of the engine is equipped with four valves, namely, main and auxiliary intake valves and main and auxiliary exhaust valves, which are independently controlled by electromagnetic actuators in accordance with the engine operation condition, thereby to control the output of the engine.

In addition, for much improving the fuel consumption against the pumping loss of the engine, there has been proposed a measure wherein control of the intake air amount is effected by controlling the close timing (or open period) of each intake valve thereby carrying out the "non-throttle operation" of the engine.

SUMMARY OF THE INVENTION

However, even in the above-mentioned measures, it is difficult to obtain a desired operation of the engine at the time when the engine is under high-speed and low-load operation because of the nature of the electromagnetic actuators. That is, the electromagnetic actuators have a limitation in speeding up the actuation to the intake valves. In other words, under high-speed operation of the engine, reduction of load is almost impossible or at least very difficult. That is, for reducing the engine torque, it is necessary to shorten the open period of each intake valve to reduce the intake air amount. This means that the intake valve has to be closed instantly just after its opening movement. However, since the valve actuating speed of the actuator is constant and a certain operation time is needed for closing the intake valve, the minimum open period with respect to the crank angle is not sufficiently small under such high-speed operation. Thus, under such high-speed operation, torque reduction by reducing the intake air amount is substantially impossible.

In view of the above, the applicants have hitherto proposed a measure that is shown Laid-open Japanese Patent Application (viz., Tokkaihei) 2000-45804. In the measure, by controlling open/close cycle of the intake and exhaust valves in accordance with an operation range of the engine, switching is carried out from a normal 4 (four)-cycle operation to a different cycle operation. More specifically, upon the engine assuming a high-speed and low-load condition, switching is carried out from 4-cycle operation to a so-called multi-cycle operation whose cycle is greater than four (4).

For ease of description, such engine operation as allowing switching between different cycle operations will be referred to as "variable cycle operation" in the following.

In view of the above, the present invention aims to provide a control system for controlling a variable valve type internal combustion engine, which suppresses or at least minimizes a torque gap that would occur upon cycle switching between 4-cycle operation and the multi-cycle operation.

With this control, improved fuel consumption due to expansion of the non-throttle operation range and improved driveability due to suppression of the torque gap are both obtained.

According to a first aspect of the present invention, there is provided a control system for controlling a variable valve type internal combustion engine. The engine has cylinders and electromagnetically actuated intake and exhaust valves arranged for each cylinder. The intake air amount fed to the cylinder is controlled by controlling the close timing of the intake valve. The control system comprises an operation range judging section that judges an operation range of the engine; a variable cycle operating section that switches the operation of the engine between 4-cycle operation and a different cycle operation in accordance with the judgment carried out by the operation range judging section, the different cycle operation being of an operation whose cycle is different from the 4-cycle; and an intermediate variable cycle operating section that allows part of the cylinders of the engine to carry out 4-cycle operation and the remaining part of the cylinders to carry out the different cycle operation when the operation range judging section judges that the engine is under an intermediate operation range between an operation range provided by the 4-cycle operation and an operation range provided by the different cycle operation.

According to a second aspect of the present invention, there is provided a control system for controlling a variable valve type internal combustion engine. The engine has cylinders and electromagnetically actuated intake and exhaust valves arranged for each cylinder. The intake air amount fed to the cylinder is controlled by controlling the close timing of the intake valve. The control system comprises means for judging an operation range assumed by the engine; means for switching the operation of the engine between 4-cycle operation and a different cycle operation in accordance with the judgment made by the operation range judging section, the different cycle operation being of an operation whose cycle is different from the 4-cycle; and means for allowing part of the cylinders of the engine to carry out 4-cycle operation and the remaining part of the cylinders to carry out the different cycle operation when the operation range judging section judges that the engine is under an intermediate operation range between an operation range provided by the 4-cycle operation and an operation range provided by the different cycle operation.

According to a third aspect of the present invention, there is provided a method for controlling a variable valve type internal combustion engine. The engine has cylinders and electromagnetically actuated intake and exhaust valves arranged for each cylinder. The intake air amount fed to the cylinder is controlled by controlling the close timing of the intake valve. The method comprises judging an operation range assumed by the engine; switching the operation of the engine between 4-cycle operation and a different cycle operation in accordance with the judgment made by the operation range judging section, the different cycle operation being of an operation whose cycle is different from the 4-cycle; and allowing part of the cylinders of the engine to carry out 4-cycle operation and the remaining part of the cylinders to carry out the different cycle operation when said operation range judging section judges that the engine is under an intermediate operation range between an operation range provided by the 4-cycle operation and an operation range provided by the different cycle operation.

According to a fourth aspect of the present invention, there is provided a control apparatus for a multi-cylinder engine. The control apparatus comprises a first section that operates a four cycle operation when the engine is in a first engine operation range; a second section that operates a different cycle operation when the engine is in a second engine operation range, the different cycle operation being different from the four cycle operation; and a third section that operates an intermediate cycle operation when the engine is in a third engine operation range, the third engine operation range being arranged between the first engine operation range and the second engine operation range, wherein a part of the cylinders are operated on the four-cycle operation and the remaining part of the cylinders are operated on the different cycle operation, in the intermediate cycle operation.

DETAILED DESCRIPTION OF THE EMBODIMENTS

Figure 1:
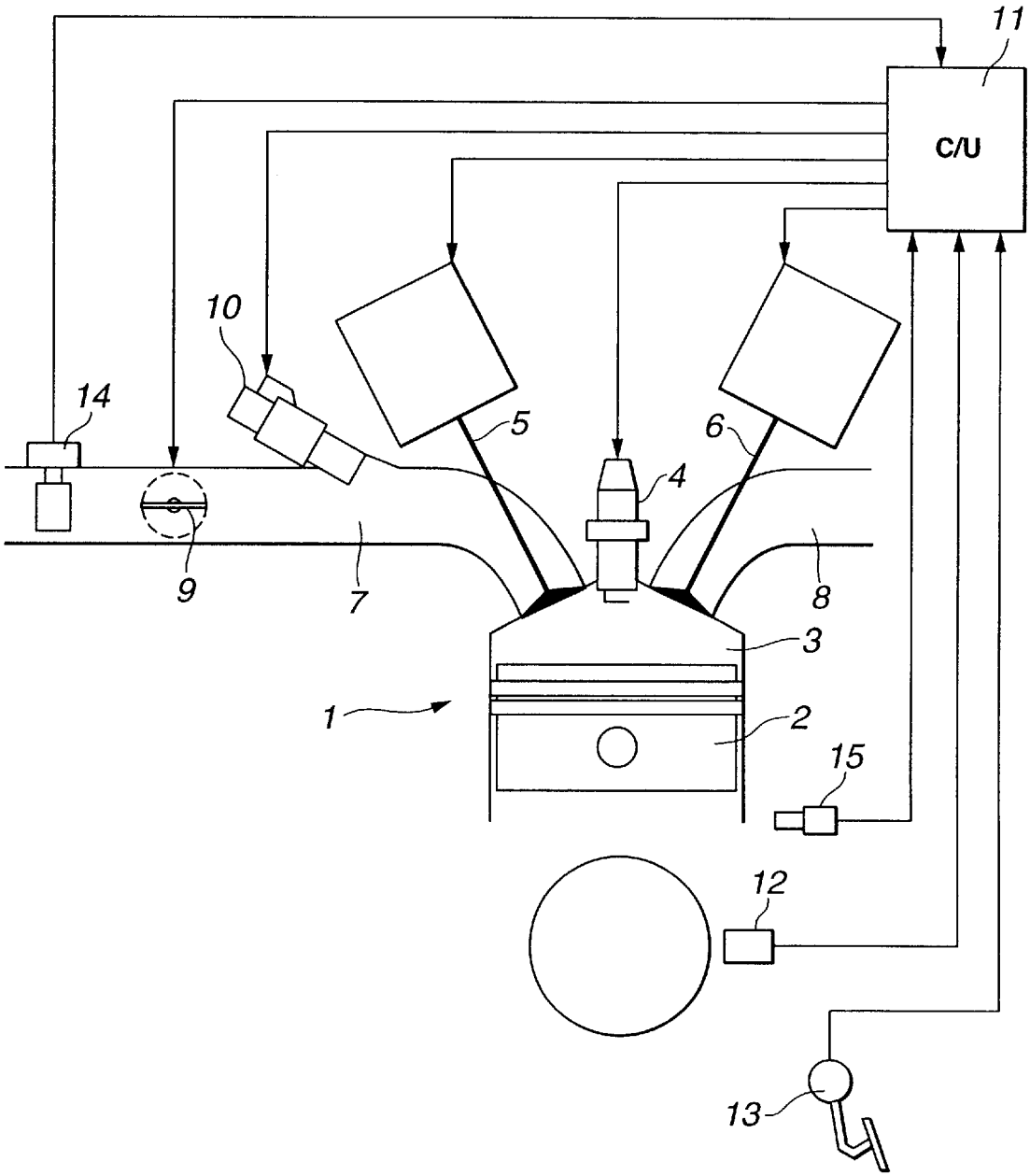
FIG. 1 is a schematic view of a variable valve type internal combustion engine to which a control system of a first embodiment of the present invention is practically applied.

Referring to FIG. 1, there is schematically shown a variable valve type internal combustion engine 1 to which a control system of a first embodiment of the present invention is practically applied.

The engine 1 has a plurality of cylinders (only one is shown) each having a piston 2 slidably received therein. In each cylinder, there is defined a combustion chamber 3 above the piston 2. An ignition plug 4 is exposed to the combustion chamber 3. An intake passage 7 is connected to intake openings of the combustion chambers 3 through an intake manifold and an exhaust passage 8 is connected to exhaust openings of the combustion chambers 3 through an exhaust manifold. Electromagnetically actuated intake and exhaust valves 5 and 6 are arranged to open and close the intake and exhaust openings.

Figure 2:
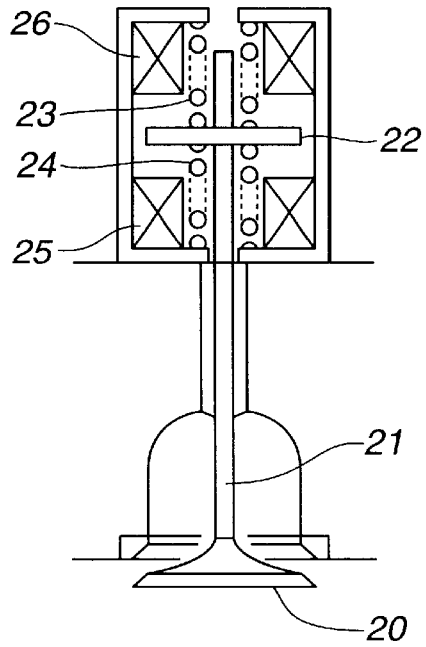
FIG. 2 is a schematic view of an electromagnetic actuator for an intake or exhaust valve of the engine.

The intake and exhaust valves 5 and 6 are actuated by electromagnetic actuators, such as one as shown in FIG. 2.

As shown in FIG. 2, the electromagnetic actuator comprises an armature plate 22 which is secured to a stem 21 of a valve 20. The armature plate 22 is held in a neutral position by upper and lower springs 23 and 24. Below and above the armature plate 22, there are arranged valve opening and closing electromagnetic coils 25 and 26 respectively. For opening the valve 20, the valve closing coil 26 is deenergized and then the valve opening coil 25 is energized. With this, the armature plate 22 is shifted downward together with the valve 20 thereby to induce an open condition of the valve 20. While, for closing the valve 20, the valve opening coil 25 is deenergized and then the valve closing coil 26 is energized. With this, the armature plate 22 is shifted upward together with the valve 20 thereby to induce a close condition of the valve 20.

Referring back to FIG. 1, in the intake passage 7 at position upstream of the intake manifold, there is arranged an electronically controlled throttle valve 9. If desired, at a position upstream of the throttle valve 9, there may be arranged a pressure-charging device, such as turbocharger, supercharger or the like. In each branch of the intake manifold, there is arranged an electromagnetic fuel injection valve 10.

The intake and exhaust valves 5 and 6, the fuel injection valve 10, ignition plug 4 of each cylinder and the throttle valve 9 are all controlled by a control unit 11. Into the control unit 11, there are inputted various information signals, which are a signal issued from a crank angle sensor 12 that represents an crank angle, a signal issued from an accelerator pedal sensor 13 that represents an accelerator opening degree "APO" (viz., accelerator depression degree), a signal issued from an air flow meter 14 that represents an intake air amount "Qa", a signal issued from a water temperature sensor 15 that represents the temperature "Tw" of engine cooling water. As is known, an engine speed "Ne" is calculated from the crank angle. The accelerator pedal sensor 13 is provided with an idle switch which is turned ON (or closed) when the accelerator pedal is released. As shown, the air flow meter 14 is positioned upstream of the throttle valve 9.

In the engine 1, for improving fuel consumption against the pumping loss of the engine, the open/close movements of the electromagnetically actuated intake and exhaust valves 5 and 6 are controlled. In particular, the close timing "IVC" of the intake valves 5 is variably controlled for controlling the intake air amount thereby to substantially carry out the non-throttle operation of the engine. In this case, the throttle valve 9 works to produce a negative pressure in the intake manifold, that is needed for canister purging, crankcase purging and the like.

The fuel injection amount and fuel injection timing of each fuel injector 10 are controlled in accordance with operation condition of the engine 1. That is, basically, the fuel injection amount is so set as to provide a desired air/fuel ratio based on the intake air amount "Qa" detected by the air flow meter 14, and with the injection ending timing being fixed to a given point before the top dead center "TDC" of intake stroke, the fuel injection starting timing is controlled so as to obtain the set fuel injection amount.

The ignition timing of the ignition plug 4 is controlled based on operation condition of the engine 1. That is, the ignition timing is set at a given point "MBT" (minimum advance for best torque) before the top dead center "TDC" of compression stroke or at a knocking limit point.

In order to expand the torque controllable range under the non-throttle operation, the engine 1 is subjected to a variable cycle operation in accordance with the operation range of the engine 1. That is, the open/close cycle of the intake and exhaust valves 5 and 6 is controlled in accordance with the operation range of the engine 1, as is depicted in FIG. 3.

In the following, the variable cycle operation will be described in detail with respect to a four cylinder engine 1.

Figure 3:
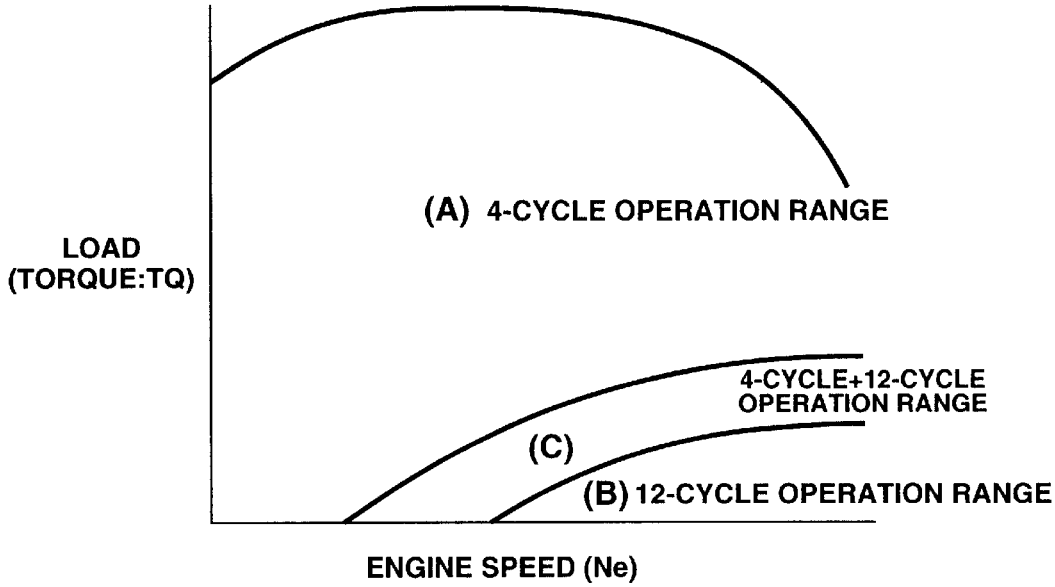
FIG. 3 is a data map used in the first embodiment for judging an operation range of the engine.

In a normal operation range "A" of FIG. 3, the engine 1 operates on the four stroke cycle, that is, (1) intake→(2) compression (ignition)→(3) explosion→(4) exhaust (during which, fuel injection takes place in the induction system). The expansion occurs at intervals of 180° in crank angle in case of the four cylinder engine 1.

While, in a high-speed and low-load operation range "B", a twelve (12)-cycle operation is carried out in the engine 1.

Figure 9:
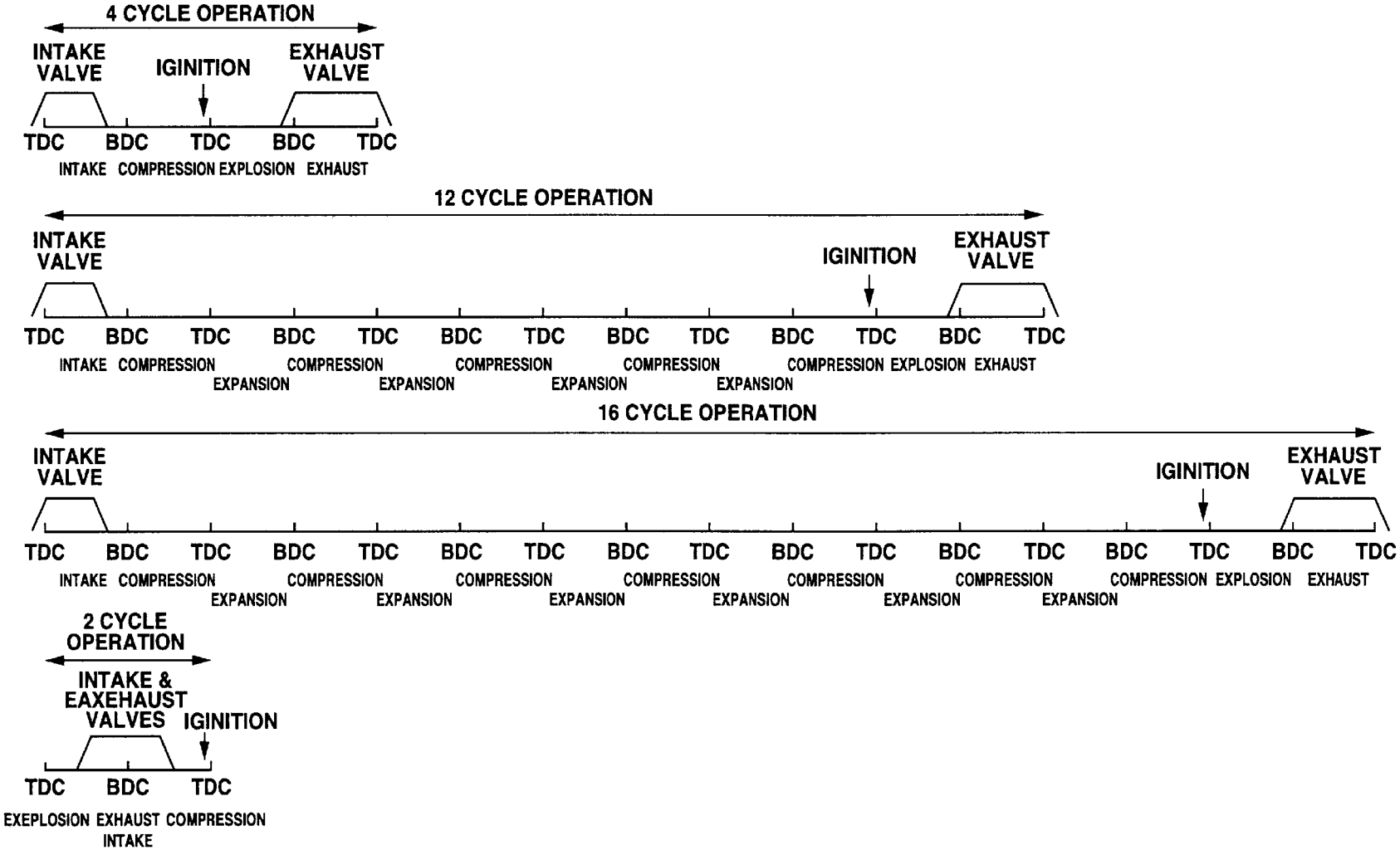
FIG. 9 is an illustration explaining a variable cycle operation.

As is shown in FIG. 9, in 12-cycle operation, each cylinder is subjected to the twelve stroke cycle, which is, (1) intake→(2) compression→(3) expansion→(4) compression→(5) expansion→(6) compression→(7) expansion→(8) compression→(9) expansion→(10) compression (ignition)→(11) explosion→(12) exhaust. That is, after the intake stroke (1), the compression/expansion strokes are repeated from (2) to (9) with both the intake and exhaust valves 5 and 6 kept closed inducing a substantial suspension of the engine 1, and after this, the compression (ignition), explosion and exhaust strokes take place at (10), (11) and (12) respectively. Thus, in 12-cycle operation of the four cylinder engine 1, the expansion occurs at intervals of 540° in crank angle. Thus, in case of 12-cycle operation, the output torque is ⅓ of that in case of 4-cycle operation. Of course, other cycle operation, such as 8-cycle operation, can be used. However, the applicants have revealed that 12-cycle operation is superior to 8-cycle operation from a vibration performance point of view.

Referring back to FIG. 3, in an intermediate operation range "C" between the normal operation range "A" and the high-speed and low-load operation range "B", that is, in the range "C" wherein the torque control is not carried out by a simple switching, the cylinders are subjected to 4-cycle operation or 12-cycle operation respectively. That is, if the ignition order is #1 →#3→#4→#2, the cylinders #1 and #4 constitute a first group and the cylinders #2 and #3 constitute a second group, and the cylinders (for example, #1 and #4) of one of the groups are subjected to 4-cycle operation and the cylinders (for example, #2 and #3) of the other group are subjected to 12-cycle operation.

Figure 4:
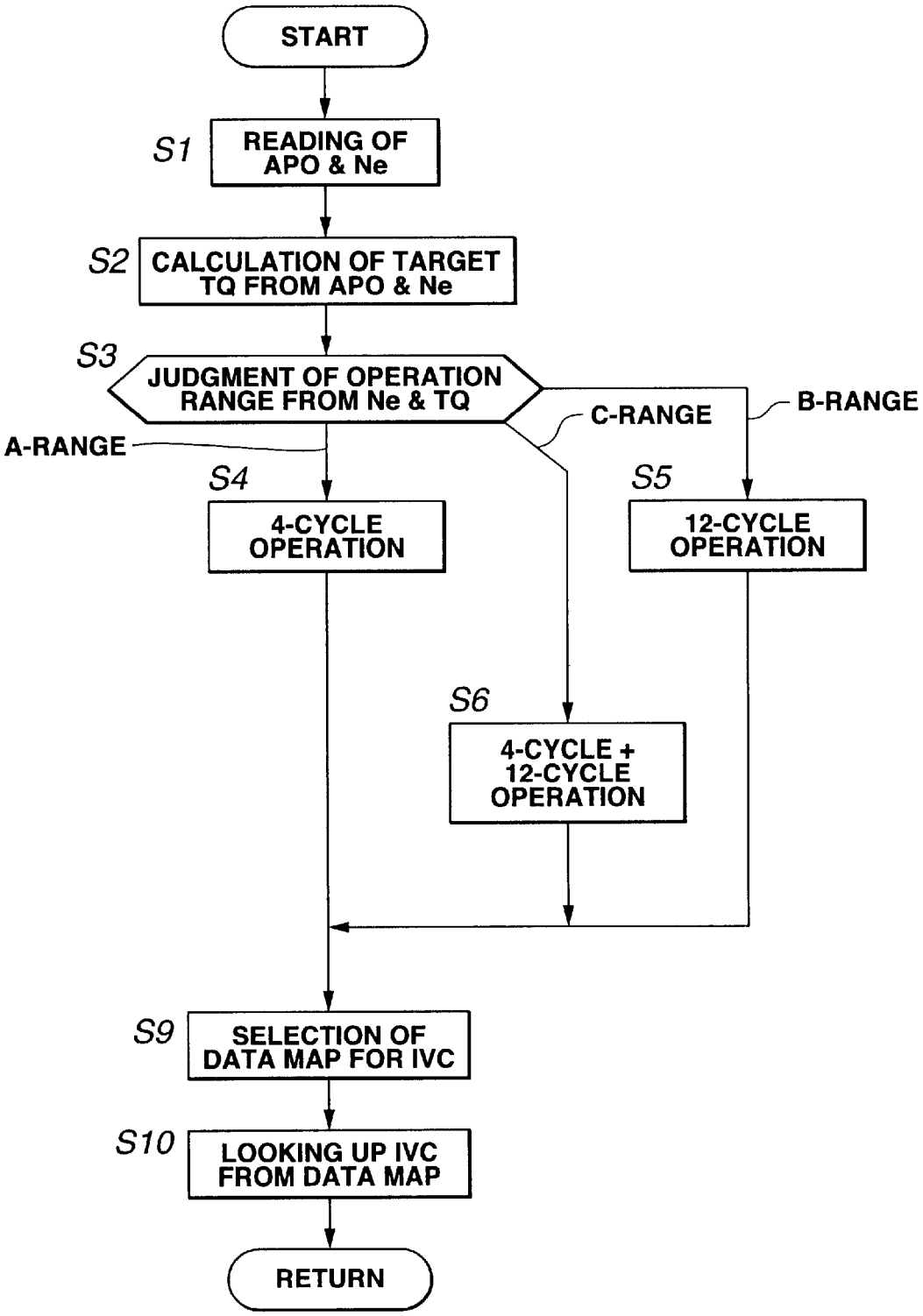
FIG. 4 is a flowchart showing operation steps executed by a control unit for controlling variable valves in the first embodiment.

In the following, the control for the engine 1 executed by the control unit 11 in the first embodiment will be described with respect to the flowchart of FIG. 4.

Figure 5:
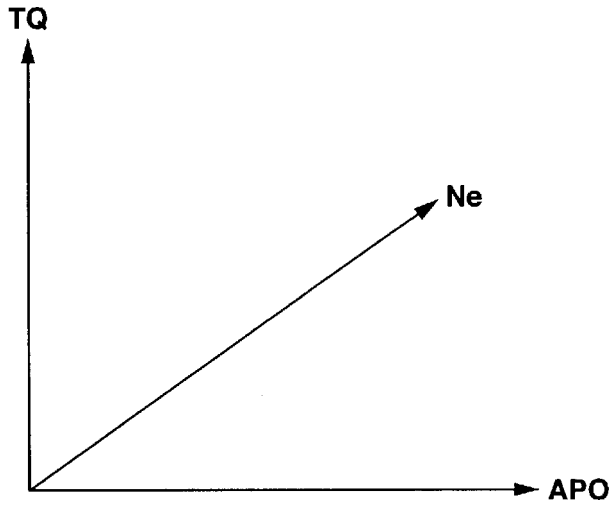
FIG. 5 is a flowchart for calculating a target torque (or, target intake air amount)

At step S1, the accelerator opening degree "APO" and the engine speed "Ne" are read, and at step S2, a target torque (viz., target intake air amount) "TQ" is looked up from a data map of FIG. 5 which shows the relation between "APO", "Ne" and "TQ".

While, when the engine 1 is idling, that is, when an idle switch is kept ON, a deviation "ΔNe" between the engine speed "Ne" and a target idling speed "Nidle", namely, "ΔNe=Ne−Nidle" is calculated, and if the deviation "ΔNe" shows a negative value, the target torque "TQ" is corrected to increase and if it shows a positive value, the target torque "TQ" is corrected to decrease.

At step 3, the operation range of the engine 1 is judged with reference to a map of FIG. 3 which shows the relation between "Ne", "TQ" and the operation range. If the judgment shows the normal operation range "A", the operation flow goes to step 54 to carry out 4-cycle operation. If the judgment shows the high-speed and low-load operation range "B", the operation flow goes to step S5 to carry out 12-cycle operation. While, if the judgment shows the intermediate operation range "C" between the normal operation range "A" and the high-speed and low-load operation range "B", the operation flow goes to step S6 to cause the cylinders to carry out 4-cycle and 12-cycle operations. That is, two cylinders are subjected to 4-cycle operation and the other two cylinders are subjected to 12-cycle operation.

Figure 6:
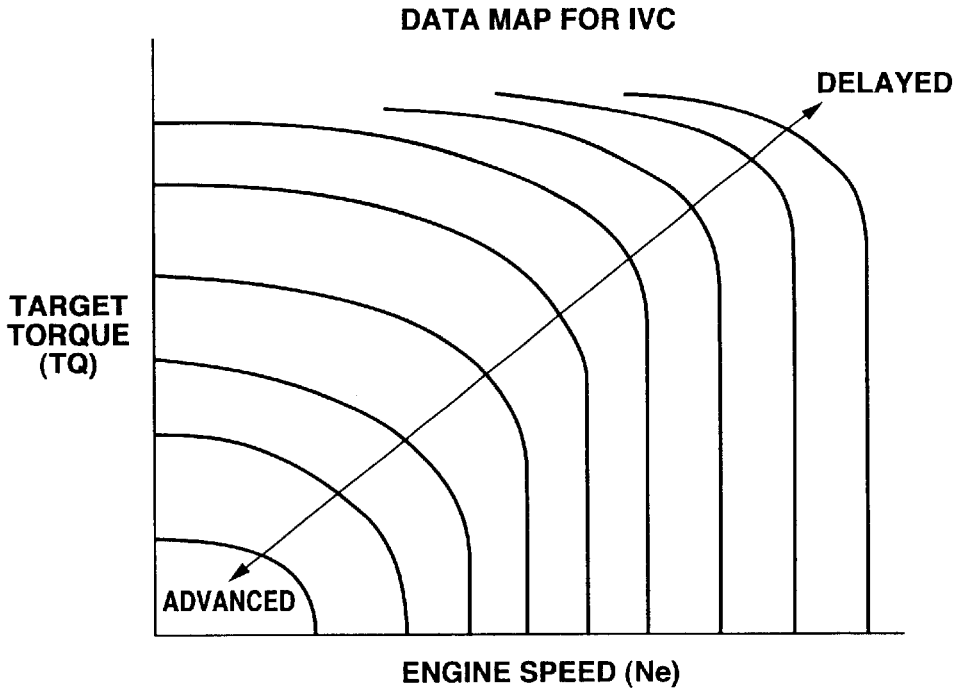
FIG. 6 is a data map used for calculating a close timing of an intake valve.

At step S9, based on the operation range "A", "B" or"C" thus judged, a data map for deriving the intake valve close timing "IVC" is selected. Then, at step S10, the intake valve close timing "IVC" for establishing the target torque (viz., target intake air amount) "TQ" is looked up from the selected data map which shows the relation between "Ne", "TQ" and "IVC" . FIG. 6 shows a data map for looking up the "IVC" in 4-cycle operation.

In the first embodiment, upon assuming the high-speed and low-load operation, the engine 1 is subjected to a cycle switching from 4-cycle operation to 12-cycle operation (viz., multi-cycle operation). Thus, in the high-speed and low-load operation range, the engine 1 sufficiently reduces its output torque, which brings about expansion of the torque-controllable non-throttle operation range of the engine 1. In the intermediate operation range between 4-cycle operation range and the multi-cycle operation range, a half (viz., two) of the cylinders are subjected to 4-cycle operation and the other half (viz., two) of the same are subjected to the multi-cycle operation (viz., 12-cycle operation), which brings about both control of the torque gap and further expansion of the torque-controllable non-throttle operation range of the engine 1. Thus, fuel consumption and drive-ability of the engine 1 are further improved.

In the following, description will be directed to a second embodiment of the present invention.

Figure 7:
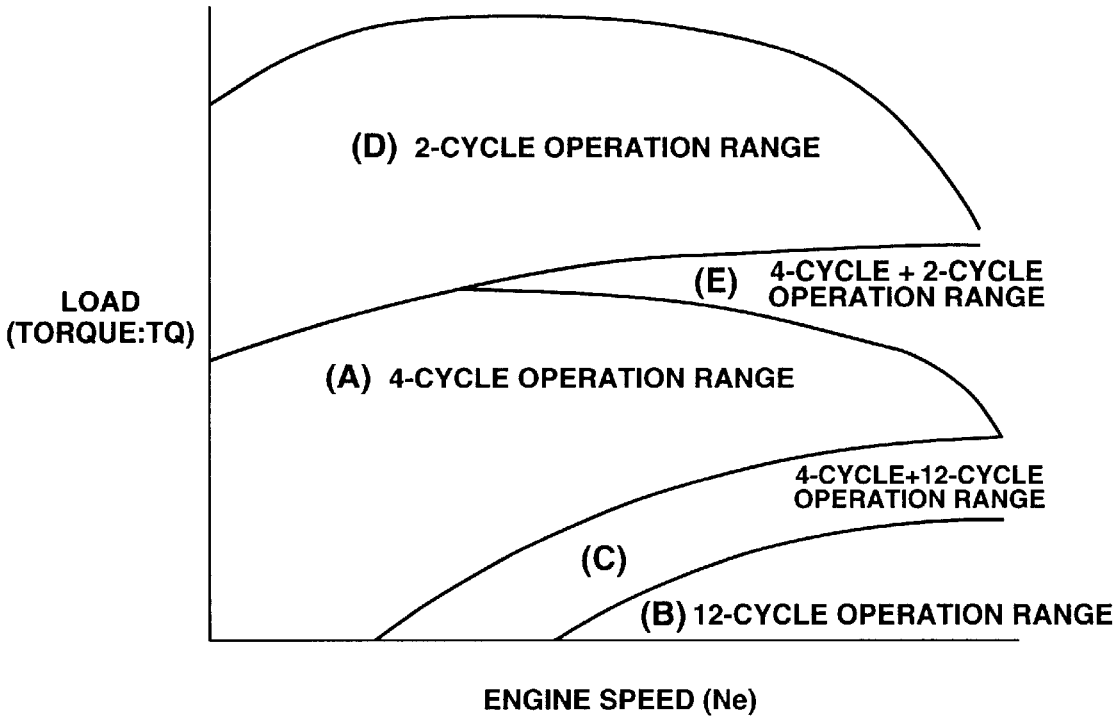
FIG. 7 is a data map used in a second embodiment for judging the operation range of the engine.

In the second embodiment, as is seen from the graph of FIG. 7, in a high-load range "D", a two (2)-cycle operation is carried out by the engine 1.

As is shown in FIG. 9, in 2-cycle operation, each cylinder is subjected to the two stroke cycle, in which during downward movement of the piston (namely, in the middle of the explosion stroke after the piston has reached the top dead center "TDC"), the intake and exhaust valves are opened at generally same time to bring about the air intake and gas discharge simultaneously at the time near (namely, just before and after) the bottom dead center "BDC" of the piston, and during upward movement of the piston (namely, in the middle of the piston lifting stroke after the piston has reached the bottom dead center "BDC"), the intake and exhaust valves are closed at generally same time to bring about a so-called compression stroke, and when the piston comes to a position just before the top dead center "TDC", ignition takes place to bring about a subsequent explosion stroke. Thus, in 2-cycle operation of the four cylinder engine 1, the explosion occurs at intervals of 90° in crank angle. Thus, the output torque is twice as much as that in case of 4-cycle operation. However, in case of 2-cycle operation, a pressure charger is may be needed because the intake and exhaust are needed at the same time by opening the intake and exhaust valves at the same time.

As is seen from FIG. 7, in an intermediate operation range "E" between the normal operation range "A" and the high-load operation range (viz., 2-cycle operation range) "D", that is, in the range "E" wherein the torque control is not easily carried out by a simple switching, the cylinders are subjected to 4-cycle operation or 2-cycle operation respectively. That is, if the ignition order is #1→#3→#4→#2, the cylinders #1 and #4 constitute a first group and the cylinders #2 and #3 constitute a second group, and the cylinders (for example, #1 and #4) of one of the groups are subjected to 4-cycle operation and the cylinders (for example, #2 and #3) of the other group are subjected to 2-cycle operation.

Figure 8:
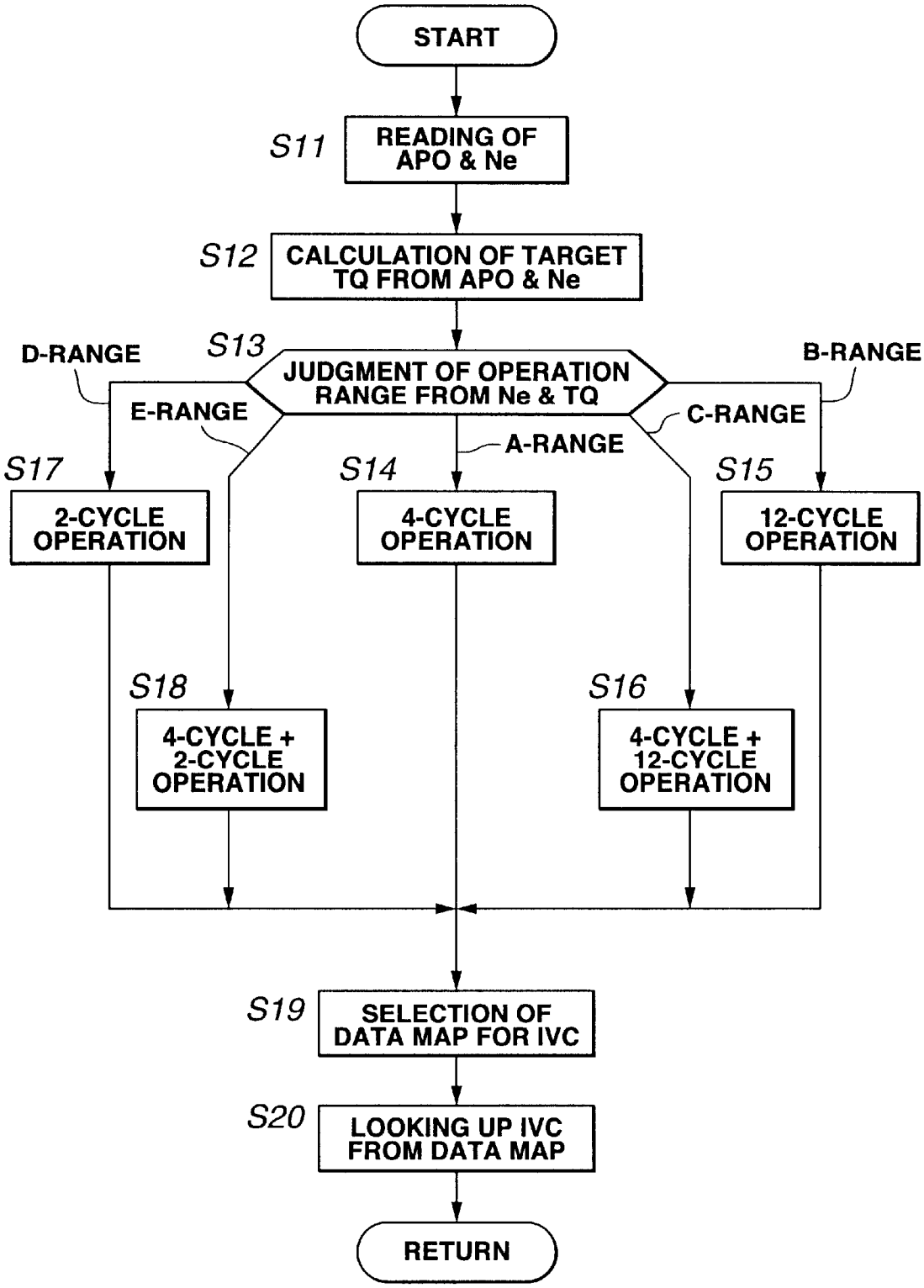
FIG. 8 is a flowchart showing operation steps executed by a control unit for controlling variable valves in the second embodiment.

In the following, the control in the second embodiment will be described with reference to the flowchart of FIG. 8.

At step S11, the acceleration opening degree "APO" and the engine speed "Ne" are read and at step 512, a target torque (viz., target intake air amount) "TQ" is looked up from a data map which shows the relation between "APO", "Ne" and "TQ". At step S13, the operation range of the engine 1 is judged with reference to the map of FIG. 7 which shows the relation between "Ne", "TQ" and the operation range. If the judgment shows the normal operation range "A", the operation flow goes to step S14 to carry out 4-cycle operation. If the judgment shows the high-speed and low-load operation range "B", the operation flow goes to step S15 to carry out 12-cycle operation. If the judgment shows the intermediate operation range "C" between the normal operation range "A" and the high-speed and low-load operation range "B", the operation flow goes to step S16 to cause the cylinders to carry out 4-cycle and 12-cycle operations. That is, two cylinders are subjected to 4-cycle operation and the other two cylinders are subjected to 12-cycle operation. If the judgment shows the high-load range "D", the operation flow goes to step S17 to carry out 2-cycle operation. While, if the judgment shows the intermediate operation range "E" of higher-speed side between the normal operation range "A" and the high-load operation range "D", the operation flow goes to step S18 to cause the cylinders to carry out 4-cycle and 2-cycle operations. That is, two cylinders are subjected to 4-cycle operation and the other two cylinders are subjected to 2-cycle operation.

Then, at step S19, based on the operation range "A", "B", "C", "D" or "E" thus judged, a data map for deriving the intake valve close timing "IVC" is selected. Then, at step S20, the intake valve close timing "IVC" for establishing the target torque (viz., target intake air amount) "TQ" is looked up from the selected data map which shows the relation between "Ne", "TQ" and "IVC".

In the second embodiment, in addition to the advantages possessed by the aforementioned first embodiment, the following advantages are expected.

That is, upon assuming the high-load operation, the engine 1 is subjected to a cycle switching from 4-cycle operation to 2-cycle operation. Thus, in the high-load operation range, the engine 1 can further increase its output performance. In the intermediate operation range between 4-cycle operation range and 2-cycle operation range, a half (viz., two) of the cylinders are subjected to 4-cycle operation and the other half (viz., two) of the same are subjected to 2-cycle operation, which brings about reduction in torque gap.

Although the above-mentioned first and second embodiments have been described with reference to a four cylinder engine, the present invention is also applicable to a six cylinder engine. In this case, in the high-speed and low-load operation range, it preferable to cause the engine to carry out 16-cycle operation.

As is shown in FIG. 9, in 16-cycle operation, each cylinder is subjected to the sixteen stroke cycle, which is, (1) intake→(2) compression→(3) expansion→(4) compression→(5) expansion→(6) compression→(7) expansion→(8) compression→(9) expansion→(10) compression→(11) expansion→(12) compression→(13) expansion→(14) compression (ignition)→(15) explosion→(16) exhaust. That is, after the intake stroke (1), the compression/expansion strokes are repeated from (2) to (13) with both the intake and exhaust valves 5 and 6 kept closed inducing a substantial suspension of the engine, and after this, the compression (ignition), explosion and exhaust strokes take place at (14), (15) and (16). Thus, in 16-cycle operation of the six cylinder engine, the explosion occurs at intervals of 480° in crank angle. Thus, the output torque is ¼ of that in case of 4-cycle operation of the engine.

Thus, in case of the six cylinder engine, in an intermediate operation range between a normal operation range (viz., 4-cycle operation range) and a high-speed and low-load operation range (viz., 16-cycle operation range), the six cylinders are subjected to 4-cycle operation or 16-cycle operation respectively. That is, in such range, a half (viz., three) of the cylinders are subjected to 4-cycle operation and the other half (viz., three) of the same are subjected to 16-cycle operation.

The entire contents of Japanese Patent Application 2000-081891 (filed Mar. 23, 2000) are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. In a variable valve internal combustion engine having cylinders and intake and exhaust valves arranged for each cylinder, the intake air amount fed to the cylinder being controlled by controlling the close timing of the intake valve, a control system for controlling the engine, comprising:

an operation range judging section that judges an operation range assumed by the engine;

a variable cycle operating section that switches the operation of the engine between 4-cycle operation and a different cycle operation in accordance with the judgment made by said operation range judging section, said different cycle operation being of an operation whose cycle is different from the 4-cycle; and an intermediate variable cycle operating section that allows part of the cylinders of the engine to carry out 4-cycle operation and the remaining part of the cylinders to carry out said different cycle operation when said operation range judging section judges that the engine is under an intermediate operation range between an operation range provided by said 4-cycle operation and an operation range provided by said different cycle operation.

2. A control system as claimed in claim 1, in which, upon judgment of said intermediate operation range, said intermediate variable cycle operating section forces a half of the cylinders to carry out 4-cycle operation and the other half of the cylinders to carry out said different cycle operation.

3. A control system as claimed in claim 1, in which, upon judgment of a high-speed and low-load operation range of the engine by said operation range judging section, said variable cycle operating section switches the operation of the engine from 4-cycle operation to a multi-cycle operation, said multi-cycle operation being of an operation whose cycle is greater than four.

4. A control system as claimed in claim 3, in which said engine is a four-cylinder engine and in which said multi-cycle operation is a 12-cycle operation.

5. A control system as claimed in claim 3, in which said engine is a six-cylinder engine and in which said multi-cycle operation is a 16-cycle operation.

6. A control system as claimed in claim 1, in which, upon judgment of a high-load operation range of the engine by said operation range judging section, said variable cycle operating section switches the operation of the engine from 4-cycle operation to 2-cycle operation.

7. In a variable valve internal combustion engine having cylinders and intake and exhaust valves arranged for each cylinder, the intake air amount fed to the cylinder being controlled by controlling the close timing of the intake valve, a control system for controlling the engine, comprising:

means for judging an operation range assumed by the engine;

means for switching the operation of the engine between 4-cycle operation and a different cycle operation in accordance with the judgment made by said means for judging an operation range, said different cycle operation being of an operation whose cycle is different from the 4-cycle; and means for allowing part of the cylinders of the engine to carry out 4-cycle operation and the remaining part of the cylinders to carry out said different cycle operation when said means for judging an operation range judges that the engine is under an intermediate operation range between an operation range provided by said 4-cycle operation and an operation range provided by said different cycle operation.

8. In a variable valve internal combustion engine having cylinders and intake and exhaust valves arranged for each cylinder, the intake air amount fed to the cylinder being controlled by controlling the close timing of the intake valve, a method for controlling the engine, comprising:

judging an operation range assumed by the engine;

switching the operation of the engine between 4-cycle operation and a different cycle operation in accordance with the judgment made by said judging an operation range, said different cycle operation being of an operation whose cycle is different from the 4-cycle; and allowing part of the cylinders of the engine to carry out 4-cycle operation and the remaining part of the cylinders to carry out said different cycle operation when said operation range judging judges that the engine is under an intermediate operation range between an operation range provided by said 4-cycle operation and an operation range provided by said different cycle operation.

9. A control apparatus for a multi-cylinder engine, comprising:

a first section that operates a four cycle operation when the engine is in a first engine operation range;

a second section that operates a different cycle operation when the engine is in a second engine operation range, the different cycle operation being different from the four cycle operation; and a third section that operates an intermediate cycle operation when the engine is in a third engine operation range, the third engine operation range being arranged between the first engine operation range and the second engine operation range, wherein a part of the cylinders are operated on the four-cycle operation and the remaining part of the cylinders are operated on the different cycle operation, in the intermediate cycle operation.

10. A control apparatus as claimed in claim 9, wherein a half of the cylinders are operated on the four cycle operation and the remaining half of the cylinders are operated on the different cycle operation, in the intermediate cycle operation.

11. A control apparatus as claimed in claim 9, further comprising intake and exhaust valves for each cylinder respectively, wherein an intake air amount fed to the cylinder is controlled in accordance with a closure timing of the intake valve.

12. A control apparatus as claimed in claim 11, wherein the intake valve is electromagnetically actuated by an actuator having an electromagnetic coil.

13. A control apparatus as claimed in claim 9, wherein the engine operation range is determined on the basis of an engine operation condition.

14. A control apparatus as claimed in claim 9, wherein the engine operation range is determined on the basis of an engine load.

15. A control apparatus as claimed in claim 14, wherein the cycle of the different cycle operation is greater than four, and the second engine operation range is arranged in a low engine load region, and the first engine operation range is arranged in a high engine load region relative to the second engine operation range.

16. A control apparatus as claimed in claim 15, wherein the engine has four cylinders and the cycle of the different cycle operation is twelve.

17. A control apparatus as claimed in claim 16, wherein a part of the cylinders are operated on the four cycle operation and the remaining part of the cylinders are operated on the twelve cycle operation, in the intermediate cycle operation.

18. A control apparatus as claimed in claim 15, wherein the engine has six cylinders, and the cycle of the different cycle operation is sixteen.

19. A control apparatus as claimed in claim 14, wherein the cycle of the different cycle operation is two, and the second engine operation range is arranged in a higher engine load region relative to the first engine operation range.

20. A control apparatus as claimed in claim 9, wherein the engine operation range is determined on the basis of an engine speed.

21. A control apparatus as claimed in claim 20, wherein the cycle of the different type operation is greater than four, and the second operation range is arranged in a high engine speed region, and the first engine operation range is arranged in a low engine speed region relative to the second engine operation range.

22. A control apparatus as claimed in claim 21, wherein the engine has four cylinders, and the cycle of the different cycle operation is twelve.

23. A control apparatus as claimed in claim 22, wherein a part of the cylinders are operated on the four cycle operation and the remaining part of the cylinders are operated on the twelve-cycle operation, in the intermediate cycle operation.

24. A control apparatus as claimed in claim 21, wherein the engine has six cylinders, and the cycle of the different cycle operation is sixteen.

25. A control apparatus as claimed in claim 9, wherein the engine operation range is determined on the basis of both an engine load and an engine speed.

26. A control apparatus as claimed in claim 25, wherein the cycle of the different cycle operation is greater than four, and the second engine operation range is arranged in a low engine load region and a high engine speed region, and the first engine operation range is arranged in a high engine load region relative to the second engine operation range.

27. A control apparatus as claimed in claim 26, wherein the engine has four cylinders, and the cycle of the different cycle operation is twelve.

28. A control apparatus as claimed in claim 26, wherein the engine has six cylinders, and the cycle of the different cycle operation is sixteen.

29. A control apparatus as claimed in claim 27, wherein a part of the cylinders are operated on the four cycle operation and the remaining part of the cylinders are operated on the twelve cycle operation, in the intermediate cycle operation.

30. A control apparatus as claimed in claim 9, wherein a part of the cylinders are operated on the four cycle operation and the remaining part of the cylinders are operated on the two cycle operation, in the intermediate cycle operation.

31. In a variable valve internal combustion engine having cylinders and intake and exhaust valves arranged for each cylinder, the amount of intake air fed to each cylinder being controlled by controlling the close timing of the corresponding intake valve, a control valve for controlling the engine, comprising:

an operation range judging section that judges an operation range assumed by the engine;

a variable cycle operating section that switches, in accordance with a judgment made by said operation range judging section, the operation of the engine between a 4-cycle operation wherein all of the cylinders are subjected to 4-cycle operation and a different cycle operation wherein all of the cylinders are subjected to a different cycle operation, said different cycle operation being of an operation whose cycle is different from 4-cycle;

an intermediate variable cycle operating section that allows part of the cylinders of the engine to carry out the 4-cycle operation and the remaining part of the cylinders to carry out the different cycle operation when said operation range judging section judges that the engine is under an intermediate operation range assumed between an operation range provided by the 4-cycle operation and an operation range provided by the different cycle operation.

* * * * *